US005332877A

United States Patent [19]

Oura et al.

[11] Patent Number: 5,332,877

[45] Date of Patent: Jul. 26, 1994

[54] PICTORIAL SYMBOL SWITCH

[75] Inventors: Takao Oura; Hideki Okada; Tatsuki Iwasaki; Nobuaki Iwabuchi, all of Kanagawa; Keishi Fujii; Hideo Mitsui, both of Hyogo, all of Japan

[73] Assignee: Mitsubishi Denki Kabushiki Kaisha, Tokyo, Japan

[21] Appl. No.: 161,079

[22] Filed: Dec. 3, 1993

Related U.S. Application Data

[63] Continuation of Ser. No. 796,920, Nov. 22, 1991, abandoned, which is a continuation of Ser. No. 544,257, Jun. 26, 1990, abandoned.

[30] Foreign Application Priority Data

Jun. 30, 1989 [JP] Japan ..... 1-76342[U]

[51] Int. Cl.[5] ..... H01H 9/00

[52] U.S. Cl. ..... 200/308; 200/312; 200/311; 200/314

[58] Field of Search ..... 200/303, 314, 311, 312

[56] References Cited

U.S. PATENT DOCUMENTS

| | | | |
|---|---|---|---|
| 4,131,777 | 12/1978 | Barley et al. | 200/311 |
| 4,262,182 | 4/1981 | Basler et al. | 200/314 |
| 4,308,439 | 12/1981 | Itoh | 200/292 X |
| 4,320,268 | 3/1982 | Brown | 200/314 X |
| 4,473,724 | 9/1984 | Suzuki | 200/5 R |
| 4,600,237 | 7/1986 | Huber et al. | 200/308 X |
| 4,608,465 | 8/1986 | Harada | 200/308 X |
| 4,742,198 | 5/1988 | Martin et al. | 200/296 |
| 4,811,175 | 3/1989 | De Smet | 200/313 |
| 4,975,547 | 12/1990 | Nakayama et al. | 200/315 |
| 4,987,279 | 1/1991 | Hirose et al. | 200/314 |
| 5,040,479 | 8/1991 | Thrash | 200/314 X |
| 5,095,409 | 3/1992 | Dematteo et al. | 362/23 |

FOREIGN PATENT DOCUMENTS

| | | | |
|---|---|---|---|
| 697619 | 11/1964 | Canada | 200/308 |
| 1107534 | 5/1961 | Fed. Rep. of Germany | 200/329 |
| 54-183044 | 12/1979 | Japan . | |
| 56-88277 | 7/1981 | Japan . | |
| 32695 | 2/1985 | Japan | 200/308 |
| 63-20336 | 2/1988 | Japan . | |

*Primary Examiner*—Ernest G. Cusick

*Attorney, Agent, or Firm*—Burns, Doane, Swecker & Mathis

[57] ABSTRACT

A pictorial symbol switch which is effective to minimize a panel and to prevent an operation in error thereof. The pictorial symbol switch comprises first and second switch units having first and second pictorial symbols indicated on surfaces thereof, respectively, and visually representing first and second events, respectively, which relate to each other and are each to take place when the first or second switch unit is depressed. Thus, an operating section and a display section are provided in an integral relationship with each other for each of the switch units of the pictorial symbol switch.

6 Claims, 2 Drawing Sheets

PICTORIAL SYMBOL SWITCH

This application is a continuation of application Ser. No. 07/796,920, filed Nov. 22, 1991 now abandoned which is a continuation of Ser. No. 07/544,257, filed Jun. 26, 1990 now abandoned.

BACKGROUND OF THE INVENTION

1. Field of the Invention

This invention relates to a pictorial symbol switch for use with a control panel of an automobile or the like.

2. Description of the Prior Art

A control panel in which a pictorial symbol switch is incorporated is often employed, for example, in an automobile. An exemplary one of conventional control panels for use with an automobile is shown in FIG. 3. Referring to FIG. 3, the conventional control panel shown is generally denoted at 1 and incorporated in a console of an automobile not shown, and a control lever 2 serving as an operating element extends outwardly from the control panel 1. The control lever 2 is mounted for linear reciprocating sliding movement along a linear lever hole or slot 3 formed in the control panel 1. A plurality of pictorial symbols 4*a*, 4*b*, 4*c*, 4*d* and 4*e* serving as display sections are indicated in a horizontal row above the lever hole 3. Then, if the control lever 2 is moved to a position corresponding to one of the pictorial symbols 4*a* to 4*e*, then an operation corresponding to the pictorial symbol 4*a*, 4*b*, 4*c*, 4*d* or 4*e* is performed. Thus, for example, if the control lever 2 is moved to the position corresponding to the pictorial symbol 4*c*, then warm wind is blown to feet of a driver.

Meanwhile, an exemplary one of conventional meter panels for use with an automobile is shown in FIG. 4. Referring to FIG. 4, the meter panel shown is generally denoted at 5 and has a display section 6 at which a driver is indicated in a pictorial symbol. In this instance, if, for example, a control switch not shown is depressed, then a portion of a driver toward which wind is to be blown is indicated by an arrow mark on the display section 6.

In both of the control panel and the meter panel having such constructions as described above, an operating element and a display section for providing a visual indication corresponding to an operation of the operating element are disposed separately from each other. Accordingly, a panel of an automobile normally has a comparatively large number of display sections thereon, and accordingly, there is a problem that the panel cannot be reduced in size readily.

SUMMARY OF THE INVENTION

It is an object of the present invention to provide a pictorial symbol switch which is effective to minimize a panel and to prevent an operation in error thereof.

In order to attain the object, according to the present invention, there is provided a pictorial symbol switch which comprises a first switch unit having a first pictorial symbol indicated on a surface thereof and visually representing a first event which is to take place when the first switch unit is depressed, and a second switch unit disposed adjacent the first switch unit and having a second pictorial symbol indicated on a surface thereof and visually representing a second event which relates to the first event and is to take place when the second switch unit is depressed.

With the pictorial symbol switch, since an operating section and a display section are provided in an integral relationship with each other, a panel or the like in which the pictorial symbol switch is incorporated can be reduced in size. Further, since each of the switch units has a pictorial symbol indicated thereon which represents an event which is to take place when the switch unit is depressed, an error in operation of the switch is prevented.

The pictorial symbol switch may further comprise third and fourth switch units disposed adjacent the first and second switch units, respectively, and having third and fourth pictorial symbols indicated on surfaces thereof, respectively, and visually representing third and fourth events, respectively, which relate to the first and second events and are each to take place when the third or fourth switch unit is depressed.

The above and other objects, features and advantages of the present invention will become apparent from the following description and the appended claims, taken in conjunction with the accompanying drawings.

DESCRIPTION OF THE PREFERRED EMBODIMENTS

Figure 1:
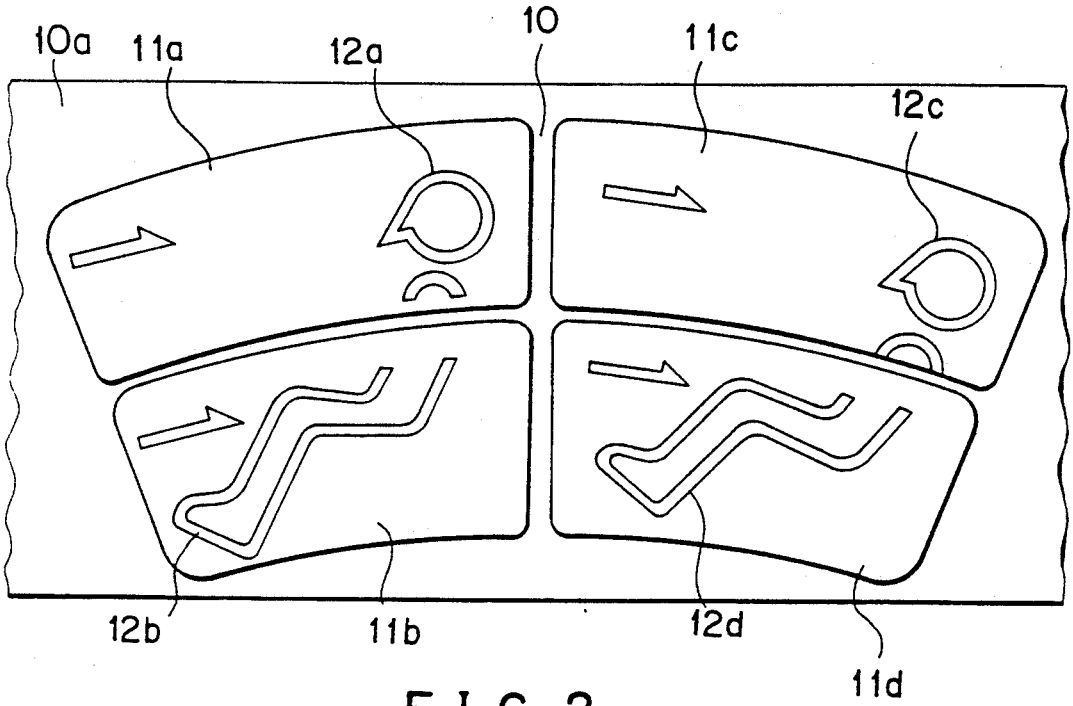
FIG. 1 is a front elevational view of a pictorial symbol switch showing a preferred embodiment of the present invention.

Referring first to FIG. 1, there is shown a pictorial symbol switch to which the present invention is applied. The pictorial symbol switch shown is generally denoted at 10 and is incorporated in an area of a control panel 10*a*, for example, of an automobile not shown. The pictorial symbol switch 10 includes a first switch unit 11*a* having a first pictorial symbol 12*a* indicated on a surface thereof. The first pictorial symbol 12*a* represents an operating condition that wind will be blown to the upper part of the body of a driver if the first switch unit 11*a* is depressed. A second switch unit 11*b* is disposed just below the first switch unit 11*a* and has a second pictorial symbol 12*b* indicated on a surface thereof. The second pictorial symbol 12*b* represents another operating condition that wind will be blown to the lower part of the body of a driver if the second switch unit 11*b* is depressed. A third switch unit 11*c* is disposed on the right-hand side of the first switch unit 11*a* and has a third pictorial symbol 12*c* indicated on a surface thereof. The third pictorial symbol 12*c* represents a further operating condition that wind will be blown to the upper part of the body of a fellow passenger on the rear seat of the automobile if the third switch unit 11*c* is depressed. A fourth switch unit 11*d* is disposed just below the third switch unit 11*d* and has a fourth pictorial symbol 12*d* indicated thereon. The fourth pictorial symbol 12*d* represents a still further operating condition that wind will be blown to the lower part of the body of a fellow passenger on the rear seat of the automobile if the fourth switch unit 11*d* is depressed.

With the pictorial symbol switch described above, an operator must only look at the pictorial symbols 12*a* to 12*d* and depress that one of the switch units 11*a* to 11*d* which corresponds to one of the pictorial symbols 12*a* to 12*d* which represents an operation of the automobile the operator wants. Accordingly, even a person who is not very familiar to operation of a switch can operate the switch smoothly. Further, since the switch units 11*a* to 11*d* are individually disposed taking a situation of an operator into consideration, an error in operation of the switch is prevented.

Figure 2:
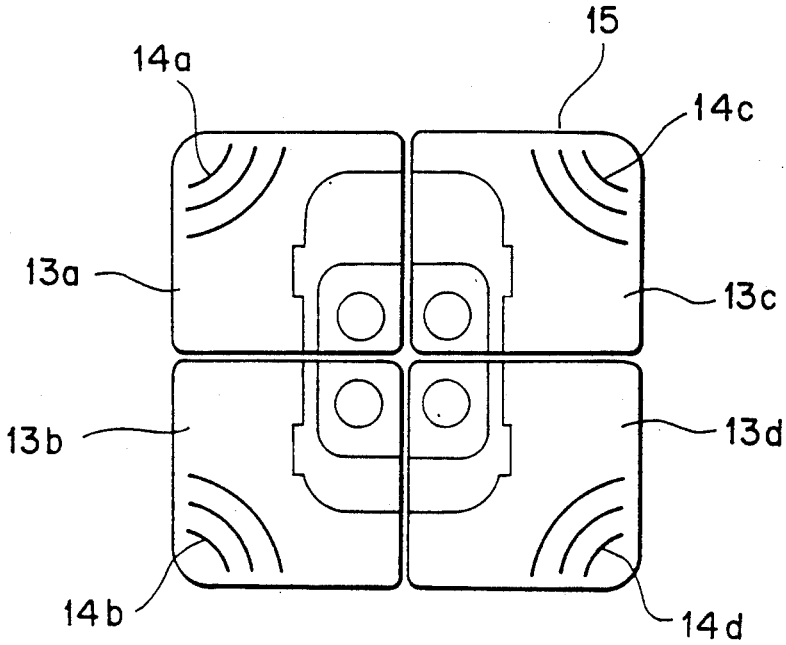
FIG. 2 is a front elevational view of another pictorial symbol switch showing another preferred embodiment of the present invention.
Figure 3:
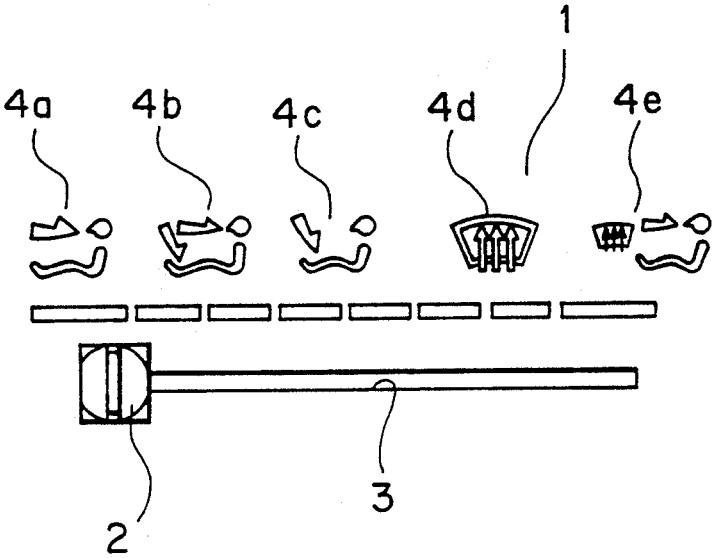
FIG. 3 (PRIOR ART)
FIG. 3 is a front elevational view showing a conventional control panel.
Figure 4:
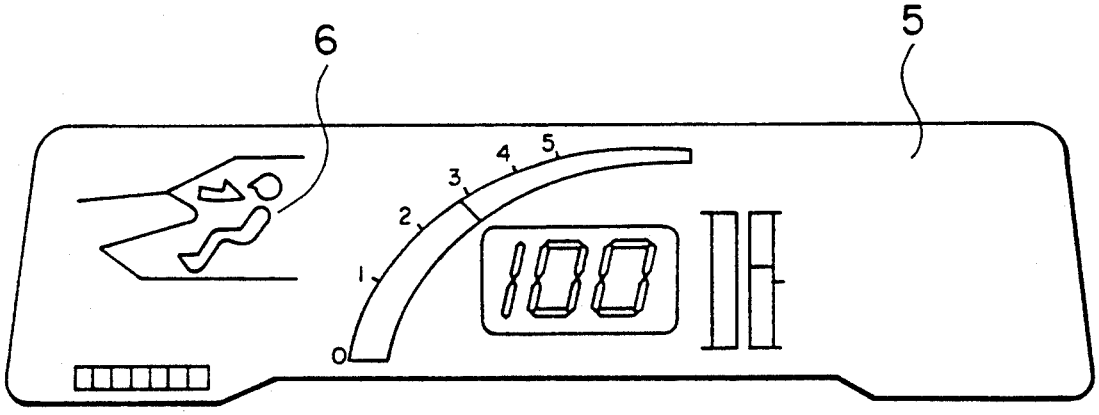
FIG. 4 (PRIOR ART)
FIG. 4 is a front elevational view showing a conventional meter panel.

Referring now to FIG. 2, there is shown another pictorial symbol switch to which the present invention is applied. The pictorial symbol switch is generally denoted at 15 and includes four switch units 13*a*, 13*b*, 13*c* and 13*d* disposed in a similar manner as in the pictorial symbol switch 10 shown in FIG. 1. The switch units 13*a* to 13*d* have pictorial symbols 14*a*, 14*b*, 14*c* and 14*d* indicated on surfaces thereof, respectively. In this instance, the pictorial symbols 14*a* to 14*d* indicate the volumes of sound from four radio speakers (not shown) disposed at left front and rear locations and right front and rear locations, respectively, in a room of the automobile. Thus, when it is desired to increase the volume of sound from the radio speaker, for example, at the right front location, the third switch unit 13*c* may be depressed.

It is to be noted that, while the pictorial symbol switches of the first and second embodiments described above are applied for the adjustment of the flow of air and the volume of sound in the room of the automobile, respectively, a pictorial symbol switch according to the present invention can naturally be applied to any other apparatus such as air-conditioning equipments, audio systems and so forth. Further, while either of the pictorial symbol switches of the embodiments described above includes four switch units each having a related pictorial symbol indicated thereon, the number of such switch units is not limited to the specific one, that is, four, and any suitable number of switch units may be provided on a pictorial symbol switch according to the present invention.

Having now fully described the invention, it will be apparent to one of ordinary skill in the art that many changes and modifications can be made thereto without departing from the spirit and scope of the invention as set forth herein.

What is claimed is:

1. A pictorial symbol switch, comprising:

a first switch unit having a first pictorial symbol on a surface thereof pictorially representing a first operation of an automotive forced air apparatus which is to take place at a first location in an enclosed environment of an automobile when said first switch unit is depressed; and a second switch unit disposed adjacent said first switch unit and having a second pictorial symbol on a surface thereof pictorially representing a second operation of said automotive forced air apparatus which relates to the first operation and is to take place at a second location in said enclosed environment when said second switch unit is depressed, each of said first and second pictorial symbols symbolically depicting how depression of a respective one of said first and second switch units is designed to affect said enclosed environment, wherein said first and second pictorial symbols, when viewed in combination, form a third pictorial symbol which symbolically depicts the enclosed environment and a relation of the first and second operations thereto; and wherein further, disposition of said first switch unit relative to said second switch unit corresponds to disposition of said first location relative to said second location in said enclosed environment.

2. A pictorial symbol switch as claimed in claim 1, further comprising third and fourth switch units disposed adjacent said first and second switch units, respectively, and having fourth and fifth pictorial symbols indicated on surfaces thereof, respectively, and visually representing third and fourth operations of said automotive forced-air apparatus, respectively, which relate to the first and second operations and are each to take place at respective third and fourth locations in said enclosed environment when said third or fourth switch unit is depressed, wherein said fourth and fifth pictorial symbols, when viewed in combination with said first and second pictorial symbols, form a sixth pictorial symbol which symbolically depicts the enclosed environment and a relation of the third and fourth operations thereto; and wherein further, disposition of said third and fourth switch units relative to one another and relative to said first and second switch units corresponds, respectively, to disposition of said third and fourth locations relative to one another and relative to said first and second locations in said enclosed environment.

3. A pictorial symbol switch as claimed in claim 1 wherein said first and second switch units are incorporated into a control panel of an automobile.

4. A pictorial symbol switch, comprising:

a first switch unit having a first pictorial symbol on a surface thereof pictorially representing a first operation of an automotive audio system which is to take place at a first location in an enclosed environment of an automobile when said first switch unit is depressed; and a second switch unit disposed adjacent said first switch unit and having a second pictorial symbol on a surface thereof pictorially representing a second operation of said automotive audio system which relates to the first operation and is to take place at a second location in said enclosed environment when said second switch unit is depressed, each of said first and second pictorial symbols symbolically depicting how depression of a respective one of said first and second switch units is designed to affect said enclosed environment, wherein said first and second pictorial symbols, when viewed in combination, form a third pictorial symbol which symbolically depicts the enclosed environment and a relation of the first and second operations thereto; and wherein further, disposition of said first switch unit relative to said second switch unit corresponds to disposition of said first location relative to said second location in said enclosed environment.

5. A pictorial symbol switch as claimed in claim 4, further comprising third and fourth switch units disposed adjacent said first and second switch units, respectively, and having fourth and fifth pictorial symbols indicated on surfaces thereof, respectively, and visually representing third and fourth operations of said automotive audio system, respectively, which relate to the first and second operations and are each to take place at respective third and fourth locations in said enclosed environment when said third or fourth switch unit is depressed, wherein said fourth and fifth pictorial symbols, when viewed in combination with said first and second pictorial symbols, form a sixth pictorial symbol which symbolically depicts the enclosed environment and a relation of the third and fourth operations thereto; and wherein further, disposition of said third and fourth switch units relative to one another and relative to said first and second switch units corresponds, respectively, to disposition of said third and fourth locations relative to one another and relative to said first and second locations in said enclosed environment.

6. A pictorial symbol switch as claimed in claim 4 wherein said first and second switch units are incorporated into a control panel of an automobile.

* * * * *